US010358783B2

(12) United States Patent
Klima

(10) Patent No.: US 10,358,783 B2
(45) Date of Patent: Jul. 23, 2019

(54) RAIL CONDITIONING SYSTEM

(71) Applicant: Progress Rail Locomotive Inc., LaGrange, IL (US)

(72) Inventor: Kevin J. Klima, Chicago, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 311 days.

(21) Appl. No.: 15/341,051

(22) Filed: Nov. 2, 2016

(65) Prior Publication Data

US 2018/0119376 A1 May 3, 2018

(51) Int. Cl.

| | |
|---|---|
| ***B05B 1/16*** | (2006.01) |
| ***B05B 9/03*** | (2006.01) |
| ***E01H 8/10*** | (2006.01) |
| ***B05B 12/12*** | (2006.01) |
| ***B05B 13/00*** | (2006.01) |
| ***B61C 15/10*** | (2006.01) |

(52) U.S. Cl.

CPC ..... *E01H 8/105* (2013.01); *B05B 1/16* (2013.01); *B05B 9/035* (2013.01); *B05B 12/122* (2013.01); *B05B 13/005* (2013.01); *B61C 15/102* (2013.01)

(58) Field of Classification Search

CPC ..... E01H 8/105; B05B 1/16; B05B 9/035; B05B 12/122; B05B 13/005

See application file for complete search history.

(56) References Cited

U.S. PATENT DOCUMENTS

| | | | | |
|---|---|---|---|---|
| 1,709,095 A * | 4/1929 | Protzeller | F16K 31/0655 | 137/348 |
| 4,930,600 A * | 6/1990 | Kumar | B61K 3/02 | 104/279 |
| 5,477,941 A * | 12/1995 | Kumar | B61C 15/107 | 184/3.2 |
| 5,687,814 A * | 11/1997 | Craig | B61K 3/02 | 184/108 |
| 6,148,732 A * | 11/2000 | Conway | B61K 3/00 | 104/279 |
| 6,276,281 B1 * | 8/2001 | Mesalic | B61C 15/08 | 104/279 |
| 7,357,427 B2 * | 4/2008 | Eadie | B61K 3/02 | 291/3 |
| 7,513,335 B2 * | 4/2009 | Kumar | B61K 3/00 | 184/3.1 |

(Continued)

FOREIGN PATENT DOCUMENTS

RU 2280728 7/2006

*Primary Examiner* — Jason C Smith

(74) *Attorney, Agent, or Firm* — Jonathan F. Yates

(57) ABSTRACT

A rail conditioning system associated with a locomotive is provided. The locomotive operates on a rail. The rail conditioning system includes a fluid supply tank. The rail conditioning system also includes a first nozzle coupled to the locomotive. The first nozzle is adapted to direct a first beam of fluid received from the fluid supply tank towards a first portion of the rail. The rail conditioning system further includes a second nozzle coupled to the locomotive. The second nozzle is adapted to direct a second beam of fluid received from the fluid supply tank towards a second portion of the rail. The rail conditioning system includes a valve element provided in fluid communication with the first and second nozzles. The rail conditioning system further includes a control module in communication with the valve element.

20 Claims, 5 Drawing Sheets

(56) References Cited

U.S. PATENT DOCUMENTS

| | | | | |
|---|---|---|---|---|
| 7,886,874 | B2 * | 2/2011 | Murphy | B61K 3/02 184/3.2 |
| 8,544,607 | B2 * | 10/2013 | Iden | B61K 3/02 184/3.2 |
| 9,089,879 | B2 * | 7/2015 | Brock | E01H 1/005 |
| 9,200,420 | B2 * | 12/2015 | Bramlett | E01H 8/105 |
| 9,421,984 | B2 * | 8/2016 | Shubs, Jr. | B61C 15/107 |
| 9,834,095 | B2 * | 12/2017 | Jacob | B60L 5/39 |
| 2015/0051760 | A1 * | 2/2015 | Worden | E01H 8/105 701/19 |
| 2018/0119376 | A1 * | 5/2018 | Klima | E01H 8/105 |

* cited by examiner

RAIL CONDITIONING SYSTEM

TECHNICAL FIELD

The present disclosure relates to a rail conditioning system, and more particularly to a rail conditioning system for a locomotive.

BACKGROUND

Locomotives experience losses in tractive effort when rail to wheel conditions are not ideal. For example, when the rail is contaminated, adhesion conditions between the rail and the wheel may be less than optimal. Typically, rail conditioners that are mounted on locomotives are used to provide a stream of air towards the rail in order to dry/clean the rails as a means of increasing the adhesion between the rail and the wheel when the rail is contaminated.

One known deficiency of current rail conditioners is that they do not provide optimal cleaning of the rails when the locomotive is going through tight curves. More particularly, relative lateral motion of the wheels with respect to the rails in tight curves may cause an air nozzle of the rail conditioner to be aimed either undershooting the center of the rail or overshooting the center of the rail, regardless if the rail conditioner is mounted directly to the truck frame or journal box. This has caused current rail conditioner designs to have a fairly wide spray pattern to ensure that the air stream can dry the rail in all degrees of curvature.

Such designs with a wide spray pattern are inefficient since a wide spray pattern tends to waste air by blowing much of the air on the ground which is not only inefficient, but also has potential to kick-up dirt and debris from the ballast back onto the rails, potentially contaminating rail conditions further. A wide spray pattern also disperses the air stream over a larger surface area on the rail rather than providing a focused beam onto the center of the rail where the wheel is most likely to contact, which does not as efficiently clean the rail compared to a more focused beam of the air. Further, it is not desirable to use a wide spray pattern and simply use a greater volume of air, as this would require a larger sized air compressor than typically used on locomotives which adds to an overall cost of the locomotive and would lower fuel efficiency. This could also increase the amount of dirt and debris being thrown up onto the rail, which is not desirable as it could make adhesion conditions even worse.

U.S. Pat. No. 5,477,941, hereinafter referred to as the '941 patent, describes a method and apparatus for optimizing on-board rail lubrication for both curved and tangent track. The lubricants are applied by an apparatus directly to the rails behind the last axle of the last locomotive of a locomotive consist. The system uses lubricant delivery nozzles which are integrated with the sand pipe and nozzle for each rail. The lubricant nozzles are aimed toward the wheel rail contact at a distance of several inches behind the contact for accurate application of one lubricant on the Top of the Rail (TOR) and another on the Rail Gage Side (RAGS). The lubricant quantities sprayed on the rail are controlled by a microprocessor with the use of a flow injection pulse, system or flow control valves. Furthermore, the microprocessor triggers sand application when emergency brakes are applied. A new method of determination of trailing tons in the train is used by averaging the total power used by the locomotives at a certain speed. However, the '941 patent does not describe a system or method to clean rails that are in a contaminated condition, nor would the '941 patent provide an effective means of cleaning the rail if it was applied to that end.

SUMMARY OF THE DISCLOSURE

In one aspect of the present disclosure, a rail conditioning system associated with a locomotive is provided. The locomotive operates on a rail. The rail conditioning system includes a fluid supply tank mounted on the locomotive. The rail conditioning system also includes a first nozzle coupled to the locomotive. The first nozzle is in selective fluid communication with the fluid supply tank. The first nozzle is adapted to direct a first beam of fluid received from the fluid supply tank towards a first portion of the rail. The rail conditioning system further includes a second nozzle coupled to the locomotive. The second nozzle is in selective fluid communication with the fluid supply tank. The second nozzle is adapted to direct a second beam of fluid received from the fluid supply tank towards a second portion of the rail. The rail conditioning system includes a valve element provided in fluid communication with the first and second nozzles. The rail conditioning system further includes a control module in communication with the valve element. The control module is configured to control the valve element in order to selectively activate each of the first and second nozzles, based on a tangent configuration of the rail. The first and second portions lie on either sides of a central portion of the rail.

In another aspect of the present disclosure, a rail conditioning system for a locomotive is provided. The locomotive operates on a rail. The rail conditioning system includes a fluid supply tank mounted on the locomotive. The rail conditioning system also includes a first nozzle coupled to the locomotive. The first nozzle is in selective fluid communication with the fluid supply tank. The first nozzle is adapted to direct a first beam of fluid received from the fluid supply tank towards the rail. The rail conditioning system further includes a second nozzle coupled to the locomotive. The second nozzle is in selective fluid communication with the fluid supply tank. The second nozzle is adapted to direct a second beam of fluid received from the fluid supply tank towards the rail. The rail conditioning system includes a valve element provided in fluid communication with the first and second nozzles. The rail conditioning system further includes a control module in communication with the valve element. The control module is configured to control the valve element in order to selectively activate any one of the first and second nozzles that is aimed at a central portion of the rail, based on a curved configuration of the rail for directing any one of the first and second beams of fluid towards the central portion of the rail.

In yet another aspect of the present disclosure, a locomotive operating on a rail is provided. The locomotive includes an air supply tank mounted on the locomotive. The air supply tank is adapted to supply pressurized air. The locomotive also includes a rail conditioning system coupled to the locomotive. The rail conditioning system includes a first nozzle coupled to the locomotive. The first nozzle is in selective fluid communication with the air supply tank. The first nozzle is adapted to direct a first beam of pressurized air received from air supply tank towards the rail. The rail conditioning system also includes a second nozzle coupled to the locomotive. The second nozzle is in selective fluid communication with the air supply tank. The second nozzle is adapted to direct a second beam of pressurized air received from the air supply tank towards the rail. The rail conditioning system includes a valve element provided in fluid communication with the first and second nozzles. The rail conditioning system further includes a control module in communication with the valve element. The control module is configured to control the valve element in order to activate each of the first and second nozzles such that the first and second nozzles receive equal pressure for directing the first and second beams of fluid towards either sides of the rail respectively. The control module is configured to control the valve element in order to activate any one of the first and second nozzles such that any one of the first and second nozzles receive a maximum pressure for directing any one of the first and second beams of fluid towards a central portion of the rail. Further, the activation is based on at least one of a tangent configuration and a curved configuration of the rail.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
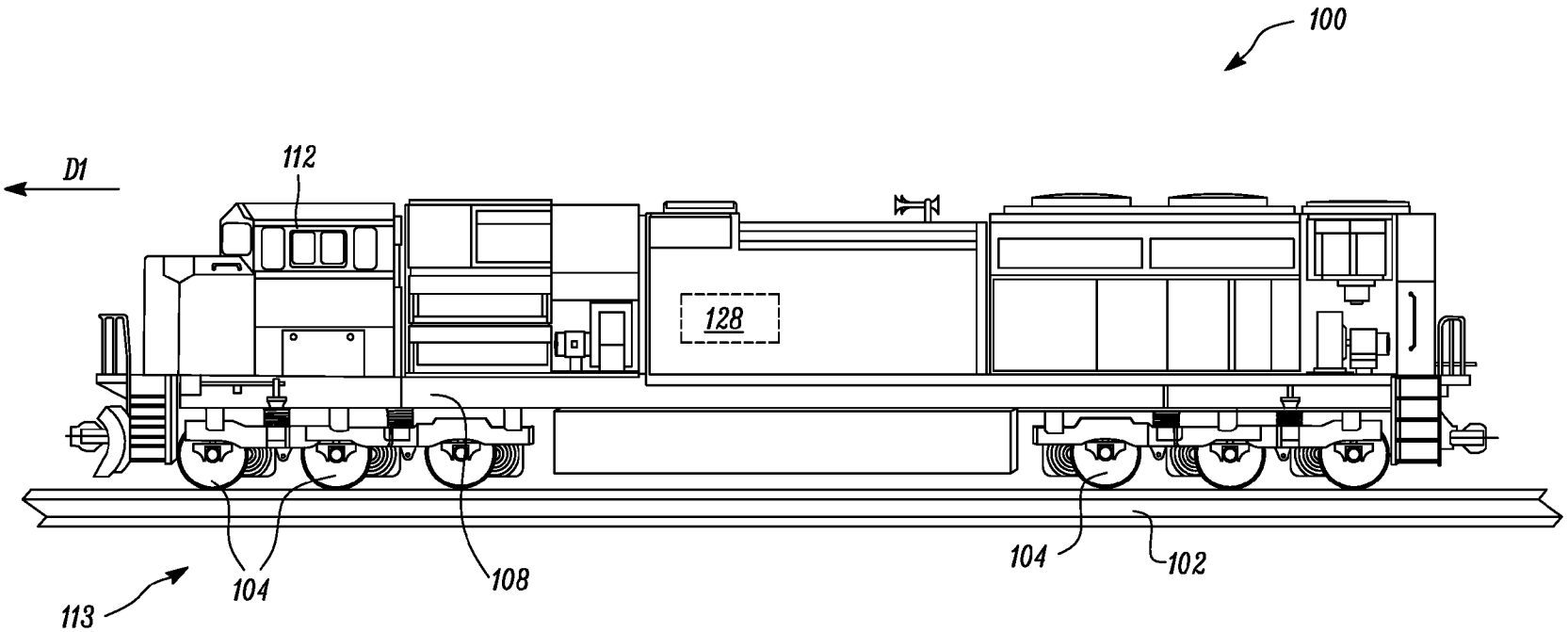
FIG. 1 is a side view of an exemplary locomotive operating on a rail, according to one embodiment of the present disclosure.

Referring to FIG. 1, an exemplary locomotive 100 operating on a rail 102 is shown. The locomotive 100 is moving in a forward direction "D1". The locomotive 100 is also movable in a reverse direction that is opposite to the forward direction "D2". The locomotive 100 may embody any of a leading locomotive or a trailing locomotive of a railway consist, without any limitations. It should be noted that the locomotive 100 may embody any other vehicle that runs on the rails 102 that are laid on a ground. The locomotive 100 runs on the rails 102 via a number of wheels 104. The locomotive 100 includes a power source (not shown), such as an engine or a battery mounted on a carbody 108 of the locomotive 100.

Figure 2:
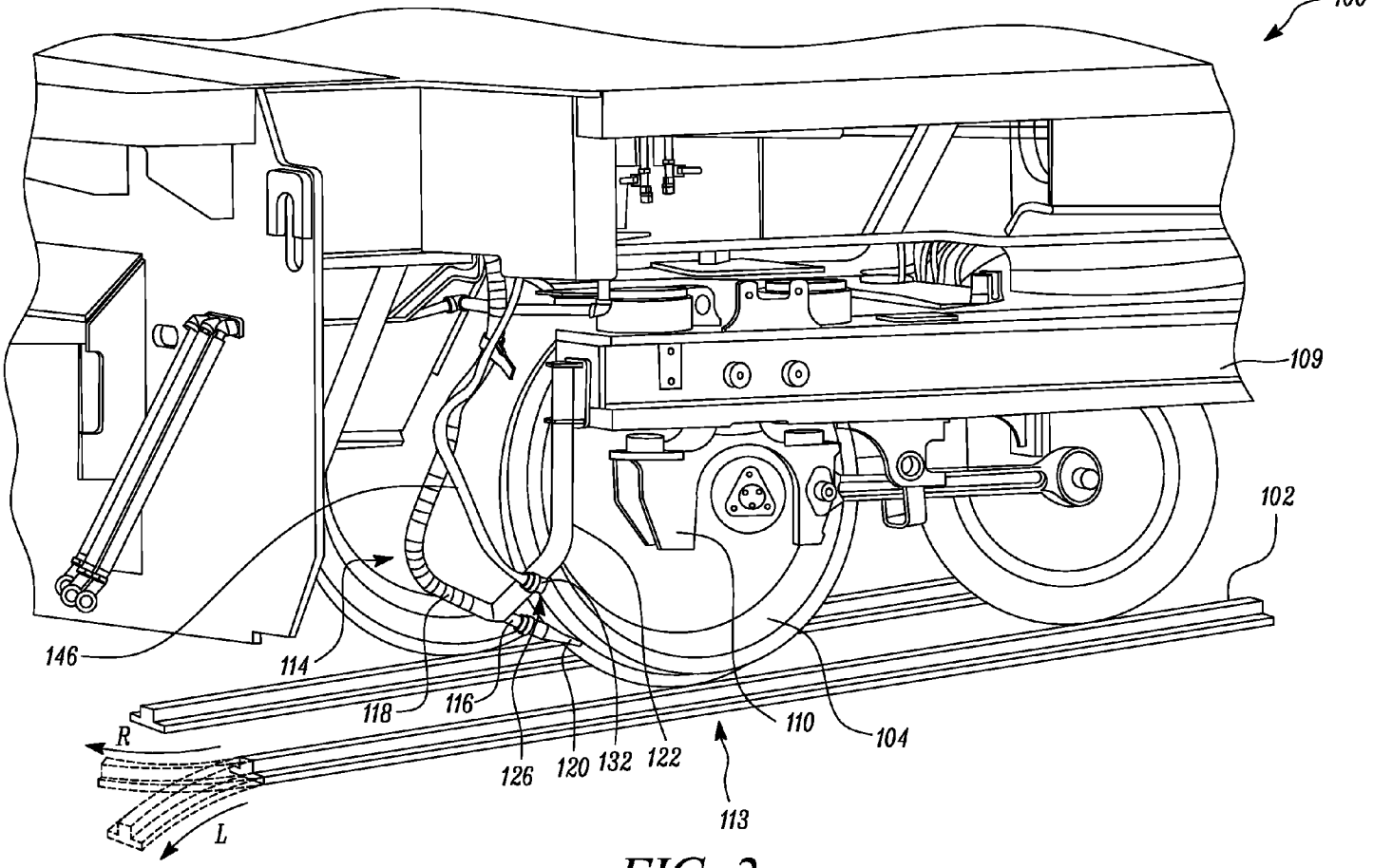
FIG. 2 is a perspective view of a lower section of the locomotive of FIG. 1.

Referring to FIG. 2, the locomotive 100 includes a journal box 110. The journal box 110 may be coupled to one or more of the wheels 104. Further, the locomotive 100 includes a number of traction motors (not shown). The traction motors may be mounted to the journal boxes 110 which are attached to a truck frame 109 of the locomotive 100. The traction motors are connected to one or more wheels 104 in order to provide tractive effort to propel and/or retard a motion of the locomotive 100. The traction motors may receive electrical power from a generator (not shown) to provide tractive power to the locomotive 100.

In one example, the locomotive 100 may be manually operated. In such an example, the locomotive 100 includes an operator cabin 112. An operator of the locomotive 100 is seated within the operator cabin 112. In another example, the locomotive 100 may be semi-autonomous or autonomous.

The locomotive 100 includes a sander assembly 114. Further, the locomotive 100 may include a number of sander assemblies 114 mounted at predefined intervals, based on system requirements. The sander assembly 114 is mounted on the locomotive 100 to improve the tractive effort of the locomotive 100. The sander assembly 114 is mounted on each of a first side 113 and a second side (not shown) of the locomotive 100. The second side is disposed opposite to the first side 113. The first side 113 of the locomotive 100 is defined on a left hand side of the operator seated in the operator cabin 112, as the locomotive 100 moves in the forward direction "D1". Whereas, the second side is defined on a right hand side of the operator seated in the operator cabin 112, as the locomotive 100 moves in the forward direction "D1".

The sander assembly 114 includes a reservoir (not shown) that stores tractive material therein. The reservoir may be mounted on the carbody 108 of the locomotive 100. The tractive material may include abrasive materials, such as sand, without any limitations. The tractive material contacts the rails 102 to modify and improve adhesion conditions of the rails 102.

Further, the sander assembly 114 includes a sander pipe 116 and a sander hose 118. The sander pipe 116 and the sander hose 118 are in communication with each other. The sander assembly 114 also includes a sander nozzle 120. The sander nozzle 120 disperses a desired volume of the tractive material on the rails 102. The sander nozzle 120 extends downwardly towards the rail 102. The sander nozzle 120 is coupled to the sander pipe 116. The sander hose 118 carries the tractive material from the reservoir towards the sander nozzle 120, via the sander pipe 116.

The sander assembly 114 may also include a sander valve (not shown). The sander valve may selectively open or close to introduce the tractive material in the sander nozzle 120, based on system requirements. In one example, the sander valve may embody a check valve, without any limitations.

The sander assembly 114 includes a sander guide 122. The sander guide 122 supports and couples the sander hose 118 with the truck frame 109 of the locomotive 100. One end the sander guide 122 is coupled to the truck frame 109 whereas another end is coupled to the sander hose 118. In an alternate example, one end of the sander guide 122 may be coupled to the journal box 110 and another end may be coupled to the sander hose 118, without any limitations.

Figure 3:
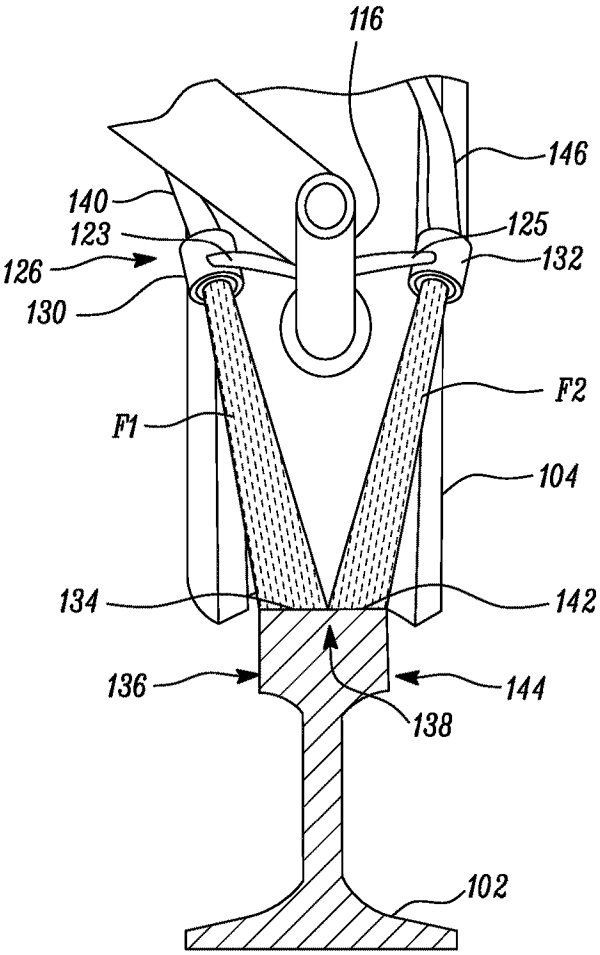
FIG. 3 is a schematic front view of a rail conditioning system associated with the locomotive of FIG. 1, when the rail is in a tangent configuration.

Referring to FIG. 3, the present disclosure relates to a rail conditioning system 126. The rail conditioning system 126 disperses a fluid, such as pressurized air, on the rails 102. The fluid may be hereinafter interchangeably referred to as pressurized air. The rail conditioning system 126 includes a fluid supply tank 128 (see FIGS. 1 and 4) mounted on the carbody 108 of the locomotive 100. The fluid supply tank 128 stores the fluid that is to be dispersed on the rails 102. Further, the fluid supply tank 128 supplies the pressurized fluid, and may be hereinafter interchangeably referred to as an air supply tank. The fluid is contained in a pressurized form within the fluid supply tank 128. Alternatively, the fluid may be stored in an unpressurized form and may be pressurized by a pump unit (not shown) associated with the fluid supply tank 128, such that the fluid supplied by the fluid supply tank 128 is in the pressurized form. Further, a shape, size, location, and material of the fluid supply tank 128 may vary, based on system requirements.

The rail conditioning system 126 also includes a pair of nozzles 130, 132. More particularly, the rail conditioning system 126 includes a first nozzle 130 and a second nozzle 132. The first and second nozzles 130, 132 are provided in a laterally spaced arrangement on opposing sides of the wheel 104 of the locomotive 100. The first and second nozzles 130, 132 are provided on either sides of the sander assembly 114. In the illustrated example, the first and second nozzles 130, 132 are mechanically coupled to a support structure of the locomotive 100. In the illustrated example, the first and second nozzles 130, 132 are mechanically coupled to the sander guide 122 of the sander assembly 114. More particularly, the first and second nozzles 130, 132 project angularly downwards from opposite sides of a first support structure 123 and a second support structure 125 of the sander guide 122, respectively, towards the rail 102.

In some examples, the locomotive 100 may omit the sander assembly 114. In such an example, the conditioning system 126 and its components may be coupled to the locomotive 100 by any support structure. For example, the support structure may embody a bracket that allows coupling of the first and second nozzles 130, 132 with the locomotive 100. A shape and size of such a support structure may vary as per system requirements.

The first nozzle 130 is in selective fluid communication with the fluid supply tank 128. The first nozzle 130 directs a first beam of fluid "F1" received from the fluid supply tank 128 towards a first portion 134 of the rail 102. The first portion 134 lies on a first side 136 of a central portion 138 of the rail 102. More particularly, the first portion 134 is defined at an outer third portion with respect to the central portion 138 of the rail 102. The first nozzle 130 is in fluid communication with the fluid supply tank 128 via a first fluid line 140.

Further, the second nozzle 132 is in selective fluid communication with the fluid supply tank 128. The second nozzle 132 directs a second beam of fluid "F2" received from the fluid supply tank 128 towards a second portion 142 of the rail 102. The second portion 142 lies on a second side 144 of the central portion 138 of the rail 102. More particularly, the second portion 142 is defined at an outer third portion with respect to the central portion 138 of the rail 102. The second nozzle 132 is in fluid communication with the fluid supply tank 128 via a second fluid line 146.

Figure 4:
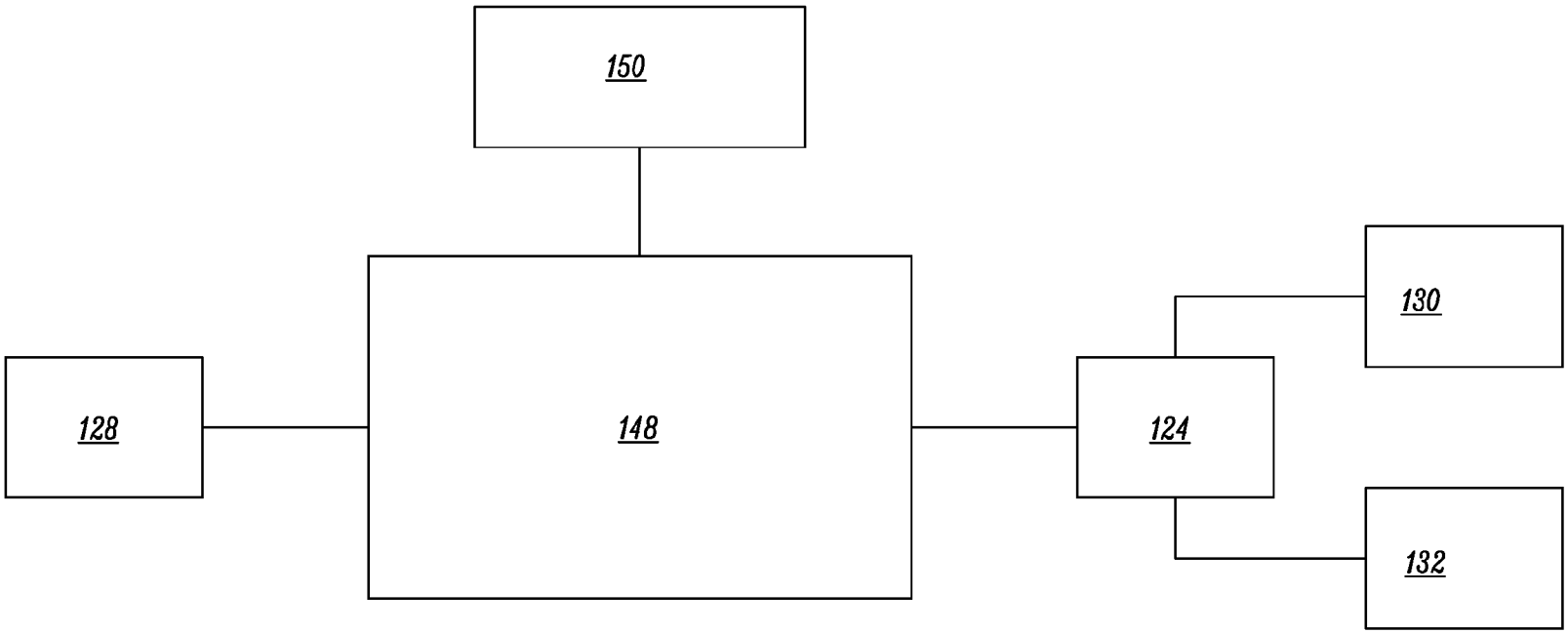
FIG. 4 is a block diagram of the rail conditioning system associated with the locomotive of FIG. 1, according to one embodiment of the present disclosure.

Referring to FIG. 4, the rail conditioning system 126 also includes a valve element 124. The valve element 124 is in selective fluid communication with the first and second nozzles 130, 132. More particularly, the valve element 124 provides selective fluid communication between the fluid supply tank 128 and the first and/or second nozzles 130, 132. In one example, the valve element 124 may embody a mag valve, or any other electronically controlled valve element. It should be noted that the valve element 124 may embody any one of a 3-way valve or a 2-way valve, without any limitations. The valve element 124 may be operated such that each of the first and second nozzles 130, 132 are in an operating position or any one of the first and second nozzles 130, 132 are in the operating position.

Alternatively, each of the first and second nozzles 130, 132 may include a valve element associated therewith. The valve elements of the first and second nozzles may open and close based on signals received from the control module 148. The opening and closing of such valve elements may cause the first and second nozzles 130, 132 to switch between the operating position and a non-operating position. In one example, the valve elements may include check valves, without any limitations.

The rail conditioning system 126 also includes a control module 148. The control module 148 may be present onboard the locomotive 100 (see FIG. 1). The control module 148 is communicably coupled to the valve element 124 of the rail conditioning system 126. The control module 148 controls the valve element 124 to selectively activate the first and/or second nozzles 130, 132 in order to direct the first and/or second beams of fluid "F1", "F2" (see FIG. 3) towards the rail 102. The activation of the first and/or second nozzles 132 is based on a configuration of the rail 102. Further, the activation may be based on a tangent configuration or a curved configuration in either direction of the rail 102. In one example, the activation of the first and/or second nozzles 130, 132 is based on a turning motion of the locomotive 100. In other words, the activation may be based when the locomotive 100 is operating on any orientation of the rail 102.

The control module 148 is also in communication with the fluid supply tank 128 and a sensor assembly 150. The sensor assembly 150 generates signals corresponding to a motion of the locomotive 100. For example, the sensor assembly 150 generates a signal indicative of the turning motion of the locomotive 100 when the locomotive 100 is operating on the rail 102 having the curved configuration. The sensor assembly 150 may include a non-contact type sensing element, such as a laser, or a contact type sensing element, such as a displacement sensor, without limiting the scope of the present disclosure. In one example, the sensor assembly 150 includes a gyro sensor.

The control module 148 operates in a first mode of operation and a second mode of operation. The first mode of operation of the control module 148 will now be explained in detail with reference to FIG. 3. The first mode of operation is activated when the locomotive 100 is operating on the rail 102 having the tangent configuration. The information corresponding to this motion of the locomotive 100 on the tangent configuration of the rail 102 may be transmitted to the control module 148 by the sensor assembly 150.

In the first mode of operation, the control module 148 (see FIG. 4) controls the valve element 124 to selectively activate each of the first and second nozzles 130, 132. Further, the first and second beams of fluid "F1, "F2" are directed towards the first and second portions 134, 142 on the respective sides 136, 144 of the rail 102. In the first mode of operation, the control module 148 also controls an outflow of the fluid from the fluid supply tank 128. The fluid from the fluid supply tank 128 is controlled so that a total volume of the fluid supplied by the fluid supply tank 128 is split such that a volume of the first beam of fluid "F1" is equal to a volume of the second beam of fluid "F2". Thus, each of the first and second nozzles 130, 132 receive equal fluid pressures for directing the first and second beams of fluid "F1, "F2" towards either sides 136, 144 of the rail 102, respectively.

Further, the second mode of operation is activated during the turning motion of the locomotive 100. In the second mode of operation, the rail 102 on which the locomotive 100 operates includes the curved configuration. In the second mode of operation, the control module 148 controls the valve element 124 to selectively activate any one of the first and second nozzles 130, 132 that is aimed at the central portion 138 of the rail 102. Further, based on the activation of the first or second nozzles 130, 132, one of the first and second beams of fluid "F1", "F2" is now directed towards the central portion 138 of the rail 102 due to a lateral motion of the wheels 104 relative to the rail 102 based on a speed of the locomotive 100 and track superelevation. Further, in the second mode of operation, the control module 148 controls the outflow of the fluid from the fluid supply tank 128 to provide a maximum fluid pressure to one of the first and second nozzles 130, 132.

Figure 5:
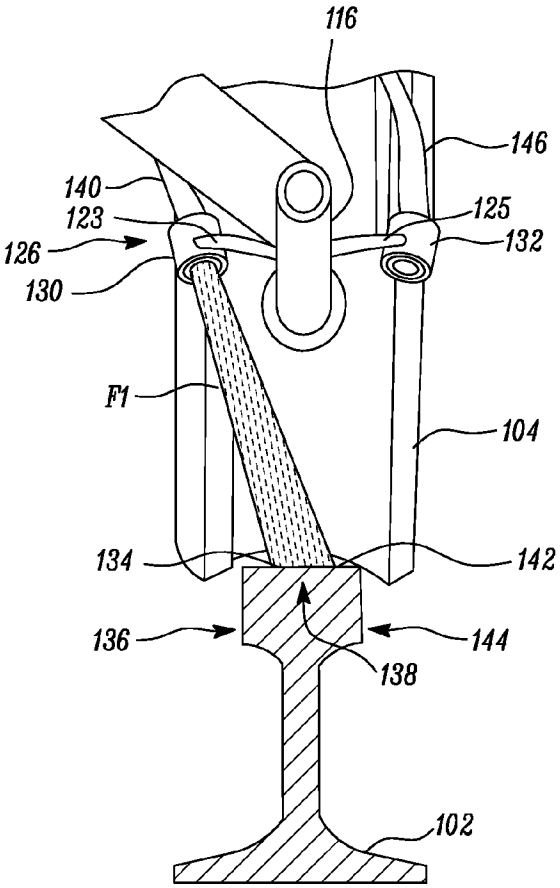
FIG. 5 is a schematic front view of the rail conditioning system associated with the locomotive of FIG. 1, when the rail is in a curved configuration.

The second mode of operation of the control module 148 will now be explained in detail with reference to FIG. 5. In the accompanying figure, the wheel 104 mounted on the first side 113 (see FIG. 1) of the locomotive 100 is shown. In such an example, when the locomotive 100 follows a left hand curve "L" (see FIG. 2) at underbalance speed, the locomotive 100 tilts towards the left hand side. The sensor assembly 150 detects the curve that is being followed by the locomotive 100 and sends information regarding the curve being followed to the control module 148. Based on the data received from the sensor assembly 150, the control module 148 may control the outflow of the fluid from the fluid supply tank 128 to provide the maximum fluid pressure to the first nozzle 130, such that the first beam of fluid "F1" is directed towards the central portion 138 of the rail 102. In such a situation, the second nozzle 132 is in the non-operating position.

Similarly, when the locomotive 100 follows a right hand curve "R" (see FIG. 2) at underbalance speed, the control module 148 may control the fluid supply tank 128 to provide the maximum fluid pressure to the second nozzle 132, such that the second beam of fluid "F2" is directed towards the central portion 138 of the rail 102. In such a situation, the first nozzle 130 is in a non-operating position. It should be noted that the left and right-hand curves "L", "R" are defined with respect to the operator seated in the operator cabin 112, as the locomotive 100 moves in the forward direction "D1".

The control module 148 may embody a single microprocessor or multiple microprocessors. Numerous commercially available microprocessors can be configured to perform the functions of the control module 148. The control module 148 may include all the components required to run an application such as, for example, a memory, a secondary storage device, and a processor, such as a central processing unit or any other means known in the art. Various other known circuits may be associated with the control module 148, including power supply circuitry, signal-conditioning circuitry, solenoid driver circuitry, communication circuitry, and other appropriate circuitry.

INDUSTRIAL APPLICABILITY

The present disclosure relates to the rail conditioning system 126 having dual nozzles 130, 132. The rail conditioning system 126 described herein details an optimized approach to rail cleaning. When the locomotive 100 operates on the rail 102 having the tangent configuration, the beams of fluid "F1", "F2" from the dual nozzles 130, 132 are directed towards the outer third portions of the rail 102 on either sides 136, 144. In this situation, the fluid supplied from the fluid supply tank 128 is split such that each of the nozzles 130, 132 receive equal volume of the fluid. Thus, the volume of fluid being supplied by the fluid supply tank 128 remains the same, thereby eliminating the requirement of a larger-sized supply tank. Also, each of the beams "F1", "F2" from the nozzles 130, 132 is much more focused, thus less volume of the fluid is wasted by being blown off the rail 102 and each of the beams "F1", "F2" from the nozzles 130, 132 together fully cover the entire rail 102.

Further, the rail conditioning system 126 of the present disclosure ensures effective cleaning of the rails 102 when the locomotive 100 is going through tight curves. During the turning motion of locomotive 100, due to a nominal offset of the nozzles 130, 132 towards the outer sides 136, 144 of the rail 102, the new design of the rail conditioning system 126 has one nozzle that is aimed completely off of the rail 102, and one nozzle that is aimed directly at the central portion 138. Since the nozzle in the operating position is aimed at the central portion 138 of the rail 102 with a focused beam, the beam of fluid from the operating nozzle ensures efficient cleaning of the rail 102. This in turn increases adhesion between the wheel 104 and the rail 102 and also increases a total tractive effort of the locomotive 100. Further, this design of the rail conditioning system 126 also reduces entry of dirt or debris from the ballast onto the rail 102, thereby maintaining a good rail condition and improving end-user satisfaction.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A rail conditioning system associated with a locomotive, the locomotive operating on a rail, the rail conditioning system comprising:

a fluid supply tank mounted on the locomotive;

a first nozzle coupled to the locomotive, wherein the first nozzle is in selective fluid communication with the fluid supply tank, the first nozzle adapted to direct a first beam of fluid received from the fluid supply tank towards a first portion of the rail;

a second nozzle coupled to the locomotive, wherein the second nozzle is in selective fluid communication with the fluid supply tank, the second nozzle adapted to direct a second beam of fluid received from the fluid supply tank towards a second portion of the rail;

a valve element in fluid communication with the first and second nozzles;

a sensor assembly including a sensor structured to generate a signal indicative of operating the locomotive on a rail having a curved configuration; and a control module in communication with the valve element, the control module configured to control the valve element to activate each of the first and second nozzles based on a tangent configuration of the rail, and to selectively activate only one of the first or second nozzles based on a curved configuration of the rail.

2. The rail conditioning system of claim 1, wherein a total volume of fluid supplied by the fluid supply tank is split such that a volume of the first beam of fluid is equal to a volume of the second beam of fluid based on the activation of each of the first and second nozzles.

3. The rail conditioning system of claim 1, wherein the fluid is pressurized air.

4. The rail conditioning system of claim 1, wherein the sensor assembly includes at least one of a non-contact type sensing element or a contact type sensing element, the sensor assembly being communicably coupled with the control module, and configured to generate a signal corresponding to a turning motion of the locomotive to determine the curved configuration of the rail.

5. The rail conditioning system of claim 1, wherein the first and second nozzles are angled downwardly towards the rail such that, when the rail is in the tangent configuration, the first and second portions are defined at an outer third and an inner third portion of the rail, respectively.

6. The rail conditioning system of claim 1, wherein the first and second nozzles are provided in a laterally spaced arrangement on opposing sides of a wheel of the locomotive.

7. The rail conditioning system of claim 1, wherein the first and second portions lie on opposite sides of a central portion of the rail when the rail is in a tangent configuration.

8. The rail conditioning system of claim 1, wherein only one of the first or the second portion is defined at a central portion of the rail when the rail is in a curved configuration.

9. The rail conditioning system of claim 1, wherein the control module is structured to control fluid delivery to split a total volume of fluid supplied by the fluid supply tank such that a volume of the first beam of fluid is equal to a volume of the second beam of fluid based on the tangent configuration of the rail.

10. A rail conditioning system for a locomotive, the locomotive operating on a rail, the rail conditioning system comprising:

a fluid supply tank mounted on the locomotive;

a first nozzle coupled to the locomotive, wherein the first nozzle is in selective fluid communication with the fluid supply tank, the first nozzle adapted to direct a first beam of fluid received from the fluid supply tank towards the rail;

a second nozzle coupled to the locomotive, wherein the second nozzle is in selective fluid communication with the fluid supply tank, the second nozzle adapted to direct a second beam of fluid received from the fluid supply tank towards the rail;

a valve element in fluid communication with the fluid supply and the first and second nozzles;

a sensor assembly including a sensor structured to generate a signal indicative of operating the locomotive on a rail having a curved configuration; and a control module in communication with the valve element and the sensor assembly, the control module configured to control the valve element to selectively activate only one of the first nozzle or the second nozzle based on the signal indicative of operating the locomotive on a rail having a curved configuration of the rail for directing the first beam of fluid or the second beam of fluid towards the central portion of the rail.

11. The rail conditioning system of claim 10, wherein the control module is further configured to control the valve element to place activate each of the first and second nozzles in fluid communication with the fluid supply tank when the rail is in a tangent configuration with respect to the locomotive.

12. The rail conditioning system of claim 11, wherein the control module is structured to split a total volume of fluid supplied by the fluid supply tank such that a volume of the first beam of fluid is equal to a volume of the second beam of fluid based on a signal indicative of a tangent configuration of the rail.

13. The rail conditioning system of claim 11, wherein the first and second nozzles project angularly downwards from the locomotive towards the rail such that the first and second beams of fluid are directed towards opposite sides of the central portion of the rail when the rail is in a tangent configuration with respect to the locomotive.

14. The rail conditioning system of claim 13, wherein the first and second beams of fluid are directed towards an outer third portion of the rail and an inner third portion of the rail, respectively, when the rail is in a tangent configuration with respect to the locomotive.

15. The rail conditioning system of claim 13, wherein a total volume of fluid supplied by the fluid supply tank is split such that a volume of the first beam of fluid is equal to a volume of the second beam of fluid based on the activation of each of the first and second nozzles.

16. The rail conditioning system of claim 10, wherein the control module is configured to control an outflow of fluid from the fluid supply tank to provide a maximum fluid pressure to only one of the first nozzle or the second nozzle when the rail is in a curved configuration with respect to the locomotive.

17. The rail conditioning system of claim 10, wherein the sensor assembly includes at least one of a non-contact type sensing element or a contact type sensing element.

18. The rail conditioning system of claim 17, wherein the sensor assembly includes a gyro sensor.

19. The rail conditioning system of claim 10, wherein the sensor assembly is further structured to generate a signal indicative of operating the locomotive on a rail having a tangent configuration.

20. A locomotive operating on a rail, the locomotive comprising:

an air supply tank mounted on the locomotive, the air supply tank adapted to supply pressurized air; and a rail conditioning system coupled to the locomotive, the rail conditioning system comprising:

a first nozzle coupled to the locomotive, wherein the first nozzle is in selective fluid communication with the air supply tank, the first nozzle adapted to direct a first beam of pressurized air received from the air supply tank towards the rail;

a second nozzle coupled to the locomotive, wherein the second nozzle is in selective fluid communication with the air supply tank, the second nozzle adapted to direct a second beam of pressurized air received from the air supply tank towards the rail;

a valve element in fluid communication with the first and second nozzles;

a sensor assembly including a sensor structured to generate a signal indicative of operating the locomotive on a rail having a tangent configuration, or a signal indicative of operating the locomotive on a rail having a curved configuration; and a control module in communication with the valve element, the control module configured to:

control the valve element, based on the signal indicative of the locomotive operating on a rail having a tangent configuration, to place the first and second nozzles in fluid communication with the air supply tank such that the first and second nozzles receive equal fluid pressure for directing the first beam of pressurized air towards a first side of the rail, and the second beam of pressurized air towards a second side of the rail, respectively; and control the valve element, based on the signal indicative of the locomotive operating on a rail having a curved configuration, to selectively place only one of the first or second nozzles in fluid communication with the air supply tank such that either the first nozzle or second nozzle receives a maximum fluid pressure for directing the first beam or the second beam of pressurized air, respectively, towards a central portion of the rail.

* * * * *